United States Patent [19]

Klingspor

[11] 4,255,819

[45] Mar. 17, 1981

[54] SOCK

[75] Inventor: Bengt G. E. Klingspor, Brämhult, Sweden

[73] Assignee: AB Eiser, Boras, Sweden

[21] Appl. No.: 33,146

[22] Filed: Apr. 25, 1979

[51] Int. Cl.[3] ..... A41B 11/02

[52] U.S. Cl. ..... 2/239; 2/243 R; 66/177

[58] Field of Search ..... 2/239, 241, 243 R; 66/177

[56] References Cited

U.S. PATENT DOCUMENTS

| | | | |
|---|---|---|---|
| 287,808 | 11/1883 | Davis et al. | 2/241 |
| 488,487 | 12/1892 | Terry et al. | 2/241 X |
| 882,951 | 3/1908 | Mettler | 2/241 X |
| 967,585 | 8/1910 | Teufel | 2/239 X |

*Primary Examiner*—H. Hampton Hunter

*Attorney, Agent, or Firm*—Harness, Dickey & Pierce

[57] ABSTRACT

A sock knitted from a yarn of non-feltable textile fibres, e.g. synthetic fibres. Into the sole, heel and toe regions of the sock is knitted a yarn of feltable textile fibres, preferably wool, forming loop pile meshes therein. After knitting, the sock is subjected to a fulling treatment, whereby the fibres of the yarn knitted into the sole, heel and toe regions of the sock are felted, thus forming soft fibrous layers internally as well as externally in these sock regions.

The loop pile meshes and the subsequent fulling treatment thereof make the sole, heel and toe regions of the sock soft and pliable. Because the entire sock is knitted from non-feltable yarns, the sock obtains the desired elasticity and good fit. After fulling the loop pile meshes from a tight structure capable of absorbing and distributing perspiration moisture.

3 Claims, 2 Drawing Figures

SOCK

BACKGROUND OF THE INVENTION

Socks are already known which are knitted entirely from wool and which are subjected to fulling for felting purposes. In the fulling treatment the mesh structure is changed in such a manner that the elasticity of the sock disappears almost entirely. The fulling treatment in addition makes the sock tight, preventing air circulation through the sock and prolonging drying thereof. The absence of elasticity likewise makes it impossible to produce a good-fitting sock.

SUMMARY OF THE INVENTION

The purpose of the subject invention is to provide a sock which is particularly devised for sports activities such as tennis, handball and similar indoor sports, where it is especially important that the skin of the sole of the feet is protected and spared as much as possible. For this reason it is essential that the sock (a) forms a soft support underneath the foot (b) has a good fit, preventing the foot from sliding inside the sock (c) efficiently absorbs perspiration moisture while at the same time allows ventilation and air circulation through the upper region of the sock, and (d) is sufficiently strong to be able to resist the stress and wear to which it is exposed during the sport activities.

All the advantages outlined above are obtained with the sock in accordance with the invention, which sock is characterised in that the sock is knitted from a yarn of textile fibres that do not lend themselves to felting, in that into the sole, heel and toe regions of the sock is knitted a yarn consisting of feltable textile fibres and forming loop pile meshes, and in that the sock, after knitting, is exposed to a fulling treatment, whereby the fibres of the yarn knitted into the sole, heel and toe regions of the sock are felted and thus form soft layers of fibres on the inside as well as on the outside surfaces of said sock regions.

Owing to the loop pile meshes knitted in the sole, heel and toe regions of the sock and to the subsequent fulling treatment, these sock regions become soft and pliable.

Since the entire sock is knitted from yarns which cannot be felted, such as e.g. synthetic yarns, the sock is imparted the desired elasticity and fit.

Because of the fulling of the loop pile meshes, formed preferably by wool fibres, a thick and dense structure is obtained which is capable of absorbing perspiration and also of distributing the moisture evenly over the sock. The moisture is ventilated through the upper portion of the foot region and the leg portion of the sock, in which regions the knit meshes are more open.

Because the sole, heel and toe regions of the sock are knitted from two thread systems, one of which comprises synthetic yarns, an extremely strong and wear-resisting sock is obtained.

The invention also comprises a method of manufacturing socks of the kind outlinded above, said method being characterised by knitting the sock from a yarn of textile fibres that do not lend themselves to felting, knitting into the sole, heel and toe regions of said sock a yarn consisting of textile fibres which can be felted, said yarn forming loop pile meshes, and fulling the sock, so as to felt the fibres of the yarn knitted into the sole, the heel and the toe regions, whereby these regions of the sock are imparted a homogeneous, felt-like surface internally as well as externally.

BRIEF DESCRIPTION OF THE DRAWING

The invention will be described in closer detail in the following with reference to the accompanying drawing, wherein.

DETAILED DESCRIPTION OF A PREFERRED EMBODIMENT

Figure 1:
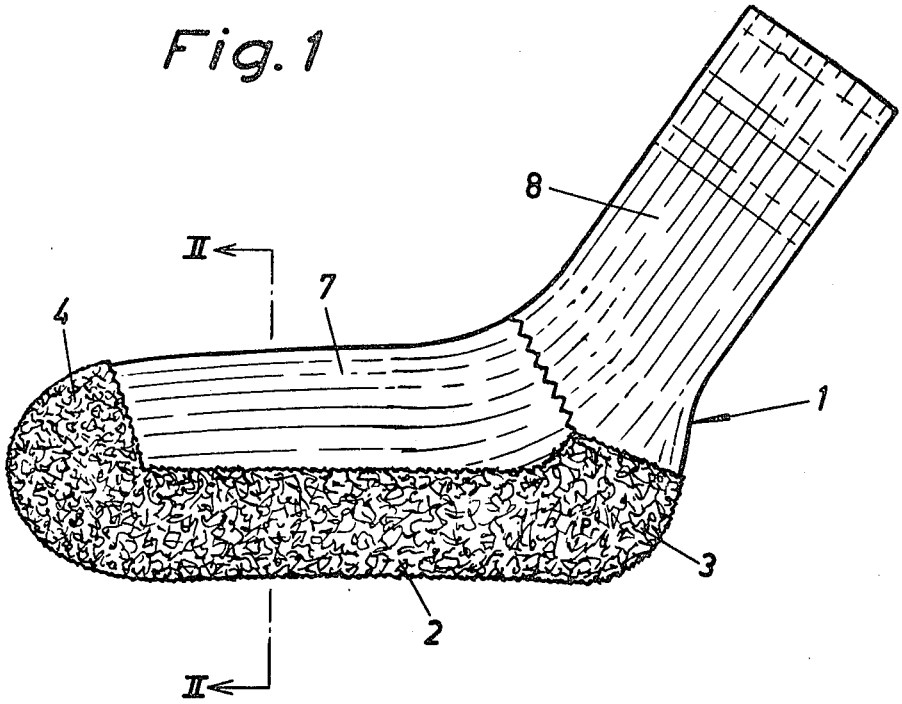
FIG. 1 is a lateral view of a sock in accordance with the subject invention.
Figure 2:
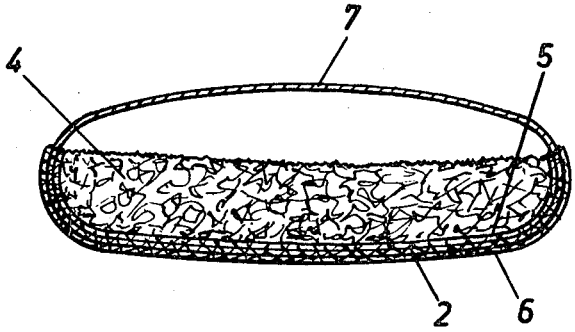
FIG. 2 illustrates on an enlarged scale a cross-sectional view through the sock along line II—II of FIG. 1.

The sock 1 is knitted in the conventional manner from a yarn which consists of textile fibres, such as acryl fibres or other similar synthetic fibres that do not lend themselves to felting. During the manufacture of the sock in accordance with the teachings of the invention a yarn which consists of feltable wool is knitted into the sole region 2, the heel region 3, and the toe region 4 of the sock, forming loop pile meshes therein preferably both on the external and the internal faces of the sock. After knitting of the sock, the latter is subjected to a fulling treatment, during which the wool fibres are felted, whereby soft fibrous layers 5, 6 are formed internally as well as externally in sole, heel and toe regions of the sock. In the fulling treatment, the mesh structure in these sock regions is altered in such a way that the elasticity partly disappears in these regions. On the other hand, the upper part 7 and the leg portion 8 of the sock remain elastic, which ensures the desired good fit of the sock. Owing to the unchanged mesh structure in the upper region of the sock and in the leg region thereof excellent air circulation and ventilation properties of the sock are obtained.

Naturally other yarns than those indicated above could be used. For instance, it is entirely within the teachings of the subject invention to make the sock entirely from wool. In this case the yarn used to manufacture the sock must be subjected to an anti-felting treatment. Various methods could be used. As one example could be mentioned the method known as the "basolane" method in which epidermis scales are removed from the wool fibres. In accordance with another method, that is known as the "herrcoosett" method the wool fibres are coated with a thin film of nylon. Only the woollen yarn knitted into the sole region 2, the heel region 3 and the toe region 4 and forming loop pile meshes therein, remain untreated, thus making it susceptible to felting treatments.

The yarns knitted into the sole, heel and toe regions need not comprise feltable material exclusively. It could be mixed with non-feltable textile fibrous material, such as cotton or rayon fibres.

The sock could be made with a high-heel region comprising a feltable yarn.

What I claim is:

1. An improved sock, particularly intended for sports activities, the improvement comprising the body of said sock being knitted from a yarn of textile fibres that do not lend themselves to felting, a yarn consisting of feltable textile fibres knitted into the fibres of said sock on the opposite side of said sole, heel, and toe regions of said sock, said yarm forming loop pile meshes, and said feltable fibres of said yarn knitted into said sole, heel, and toe regions of said sock being felted and thus form soft layers of fibres on the inside as well as on the outside surfaces of said sock sole, heal and toe regions.

2. An improved sock as claimed in claim 1, wherein said feltable yarn knitted into said sole, heel, and toe regions of said sock consist of feltable wool.

3. A method of manufacturing an improved sock, particularly intended for sports activities, comprising the steps of knitting the body of said sock from a yarn of textile fibres that do not lend themselves to felting, knitting into the inner and outer surfaces of the sole, heel, and toe regions of said sock a yarn consisting of textile fibres which can be felted, said feltable yarn forming loop pile meshes, and fulling said sock so as to felt said feltable fibres of said yarn knitted into said sole, heel, and toe regions of said sock, whereby said regions of the sock are imparted a homogeneous, felt-like surface internally as well as externally.

* * * * *